United States Patent [19]

Neumann

[11] 4,374,565

[45] Feb. 22, 1983

[54] STAND FOR WRITING DEVICES

[75] Inventor: Ruediger Neumann, Kiel, Fed. Rep. of Germany

[73] Assignee: Koh-I-Noor Rapidograph, Inc., Bloomsbury, N.J.

[21] Appl. No.: 187,665

[22] Filed: Sep. 16, 1980

[30] Foreign Application Priority Data

Sep. 27, 1979 [DE] Fed. Rep. of Germany ... 7927469[U]

[51] Int. Cl.[3] ..... A47F 7/00

[52] U.S. Cl. ..... 211/69.5; 211/168

[58] Field of Search ..... 211/69.5, 69.6, 168, 211/170, 96, 99, 60 R

[56] References Cited

U.S. PATENT DOCUMENTS

| | | | |
|---|---|---|---|
| 2,011,040 | 8/1935 | Cuthbert . | |
| 2,752,888 | 7/1956 | Dalton . | |
| 2,957,270 | 10/1960 | Kennamer . | |
| 3,176,662 | 4/1965 | Williams . | |
| 3,428,380 | 2/1969 | Daniczek . | |
| 3,463,323 | 8/1969 | Riepe | 211/69.5 |
| 3,499,626 | 3/1970 | Barker | 211/99 X |
| 3,724,676 | 4/1973 | Anderka | 211/69.7 |
| 3,866,992 | 2/1975 | Katz | 211/69.5 |

FOREIGN PATENT DOCUMENTS

| | | | |
|---|---|---|---|
| 1511474 | 11/1969 | Fed. Rep. of Germany . | |
| 681660 | 5/1930 | France | 211/69.6 |

*Primary Examiner*—James T. McCall
*Assistant Examiner*—Robert W. Gibson, Jr.
*Attorney, Agent, or Firm*—David H. Semmes; Warren E. Olsen

[57] ABSTRACT

A stand for writing utensils, particularly tubular writing pens, which comprise a lower part that can be placed on a base, and an upper part, that is pivotally mounted on the lower part and has at least one hole for receiving a writing pen. The upper part engages the lower part by means of laterally extending bearing pins, which extend from at least two supports which extend upwardly from the lower part. The invention is significantly characterized in that the bearing pins, 6 and 7, are provided on the upper end region of the supports, 4 and 5, and that within the top part, 10, are guide slots, 16, which are open to the bottom of the upper part and extend upwardly for the bearing pins, 6 and 7. Hence, the top part, 1, may rest in a tilted position due to a frictional cooperation between the guide pins and the guide slots, and a bearing by a longitudinal edge upon the bottom part, 1.

5 Claims, 4 Drawing Figures

STAND FOR WRITING DEVICES

BACKGROUND OF THE INVENTION

1. Field of the Invention

The invention relates to a stand for writing devices, particularly tube writers, with a lower part that can be placed on a base and an upper part pivotingly held to this and having tubes to receive the writing devices, said upper part is held in place by laterally extending bearing pins on at least two supports which extend upwardly from the lower part.

2. Description of the Prior Art

With a known prior art stand, (DE-PS No. 19 41 238), the bearing pins are located on the lateral end walls of the upper part and rest in slots on the supports that are open above, i.e., the upper part hangs by means of its bearing pins in bearing bushings upwardly open and can be easily installed and removed as a result. There is the danger with this solution that the user may inadvertently knock or lift the upper part out of the supports which can damage the writing devices held therein.

SUMMARY OF THE INVENTION

Accordingly, it is the object of the invention to provide a stand for writing devices, particularly tube writers in which the upper and lower parts can be easily mounted, on the one hand, and also so there is practically no danger of the two parts being inadvertently separated from one another, in spite of the adjustability of the upper part relative to the lower part, on the other hand.

In a preferred embodiment of this object, a stand of the type mentioned at the outset is constructed, according to the present invention, so that bearing pins are provided in the upper end region of the supports, and the upper part has guide slots extending from below, to above, and open at the bottom for the bearing pins. Hence, the upper part rests with a lower longitudinal edge on the lower part in pivoted position, whereby the guide slots are preferably located near the backside of the upper part. The backward limit of the guide slots is to rest on the backside of the supports in an unpivoted position of the upper part. The guide slots are wider in their upper regions than the diameter of the bearing pins, hence a pin surface rests on the forward limit of the upper region of the guide slots, in an unpivoted position of the upper part.

With the stand made according to the present invention, the upper part is "stuck on" the supports of the lower part. To pivot, the upper part is raised opposite the supports relative to the bearing pins, so that the bearing pins move downward in the guide slots while the upper part is held by contact at least on one marginal edge of the guide slots and by contact of a lower longitudinal edge on the under part, while in the pivoted position.

The lower part can have a contact surface for the upper part, upon which the unpivoted upper part will lie flat and in the pivoted position, the upper part will rest on its forward longitudinal edge.

In order to make them as unobtrusive as possible, for visual reasons, the distance between adjacent supports is preferably less than the distance between the lateral end walls of the upper part, i.e., the supports are located in corresponding cutouts or slots in the upper part. The upper part in this case can have continuous, surrounding front and rear walls that cover the supports, so that openings for the entry of the supports, into the corresponding cutouts in the upper part, are located only in the bottom of the upper part.

DETAILED DESCRIPTION OF THE PREFERRED EMBODIMENT

The stand illustrated consists of a lower part, 1, and an upper part, 10, which can both be made of plastic. The lower part, 1, has a support surface, 2, and an upper surface, 3, from which two plate-shaped supports, 4 and 5, extend upward, with each support having a bearing pin, 6 and 7, on their distal ends, which pins point to the outside. As is most particularly shows in FIGS. 3 and 4, the lower section, 8, of the rear surface edge of the support runs from the surface, 3, perpendicularly upward, while the surface edge section, 9, extending thereabove runs forward and ends tangentially on the bearing pin. The forward edges of the supports, 4 and 5, also run tangentially to the bearing pins in the region of the bearing pin, so that the supports there have the same width as the bearing pins (FIGS. 3 and 4).

Figure 2:
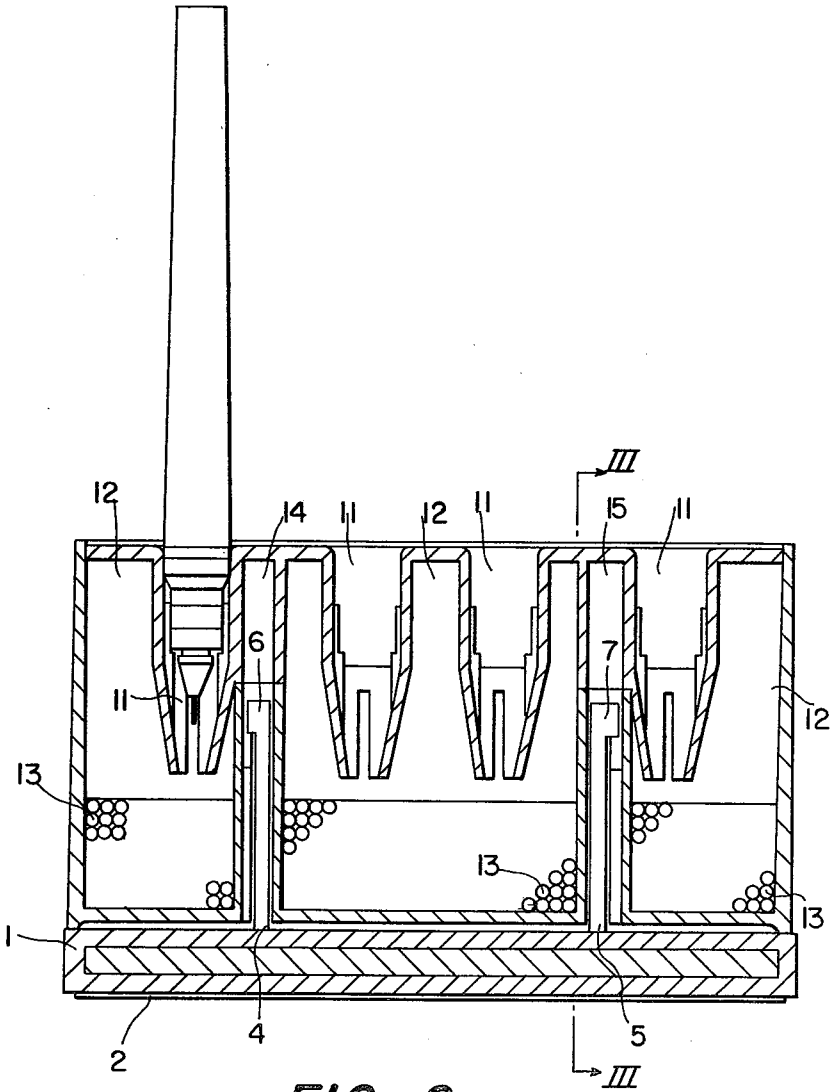
FIG. 2 shows a section through the stand in FIG. 1 along line II—II in FIG. 3.
Figure 1:
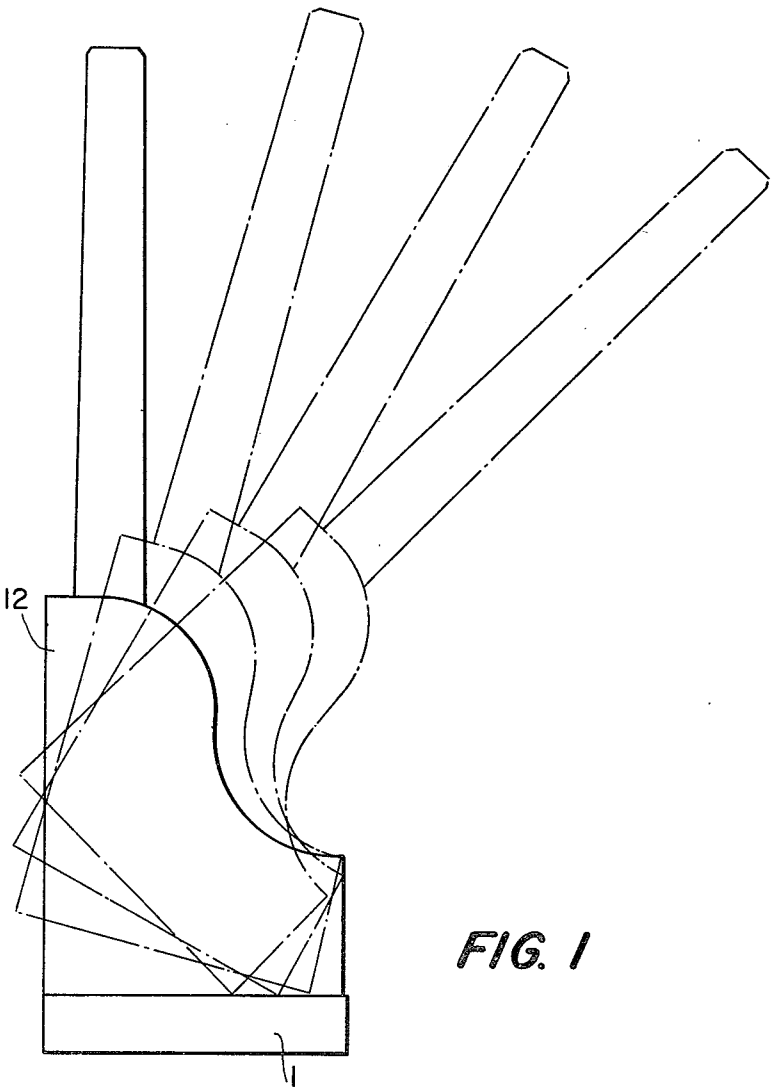
FIG. 1 shows a side view of a stand for tube writers, depicting various positions of the upper part.

The upper part, 10, comprises a hollow space, 12, into which the tubes, 11, extend, and are open into the hollow space (FIG. 2). Located in the hollow space is an absorbent material, 13, which can be soaked in water so that the air humidity is high around the writing tips of the inserted tube writers, thus preventing them from drying out. The upper part hollow space, 12, is interrupted by slots, 14 and 15, which have the same relative spacing as the supports, 4 and 5, and these slots form guide slots, 16, for the lower part (FIGS. 3 and 4). These guide slots are open downward and have essentially the same width in their lower region, 18, as the bearing pins, while their upper region, 17, is broader, with its breadth defined to coincide with the distance between the edge section, 8, of the supports and the inside edge of the upper end of the supports, i.e., the inside edge of the bearing pins (FIG. 3). The front sides of each of the guide slots, 16, are limited by a ridge, 19, and the backsides of each guide are limited by partition wall, 22, which is shown to run parallel to both the rear wall, 21, and the front wall, 20.

Figure 3:
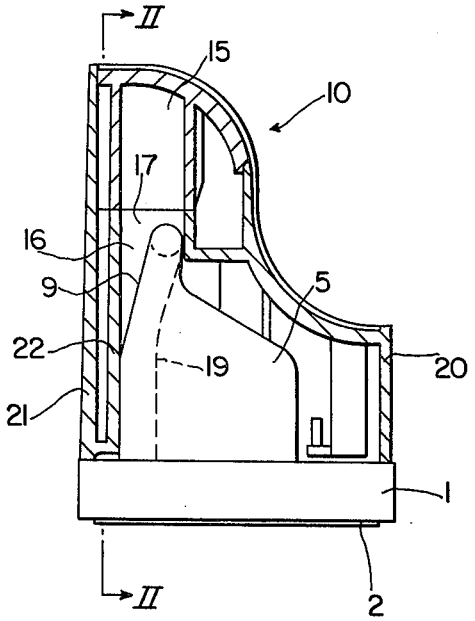
FIG. 3 shows a section through the stand according to FIGS. 1 and 2 along the line III—III in FIG. 2.
Figure 4:
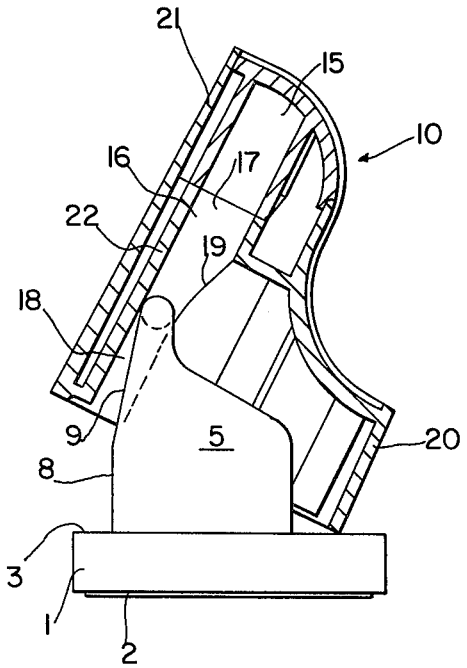
FIG. 4 shows a sectional view corresponding to FIG. 3 of the stand with a pivoted upper part.

In the unpivoted position of FIG. 3, the upper part, 10, rests with its lower edges of the front wall, 20, the real wall, 21, and the end walls, all upon the upper surface, 3, of the lower part, 1. Also, the lower surface edge sections, 8, of each of the supports, 4 and 5, then rests against the partition wall, 21. To bring the upper part, 10, into a pivoted, working position, in which the tube writers can more easily be inserted and removed from the tubes, the upper part is lifted and tilted so that the lower edge of the back wall, 21, moves free of the upper surface, 3, while the lower edge of the front wall, 20, i.e., the forward longitudinal edge thereof, continues to rest on the upper surface, as shown in FIG. 4. In this pivoted position, the upper part is held stationary, on one side, by a frictional contact with the surface, 3, and on the other side, by a frictional contact of the bearing pins with the converging, opposing surfaces which define the lower section, 18 of the guide slots, 16. The attitude or degree of pivoting, of the upper part can thereby be constantly changed without the danger of completely tipping the upper part over, or separating it from the lower part.

While a preferred embodiment of my invention has been illustrated, the invention is to be limited solely by the scope of the appended claims.

I claim:

1. A stand for writing devices, such as tube writers and the like, comprising a lower part, that is adapted to be placed upon a, supporting surface and an upper part which is mounted for pivotable movement with respect to said lower part and which further comprises means to accept at least one writing device, wherein said upper part is in bearing contact with laterally extending bearing pins of said lower part which extend from each of at least two supports extending upwardly from the lower part, wherein the bearing pins (6 and 7) extend laterally proximate the upper end area of each of said support (4 and 5) wherein the upper part (10) further comprises guide slots (16) which are open to the bottom of said upper part and extend upwardly within said upper part and accept said bearing pins, whereby the bearing pins (6 and 7) and the upper part (10) are operable to frictionally engage in a pivoted position, so that a lower longitudinal edge of the upper part rests upon an upper surface of the lower part (1).

2. A stand according to claim 1, wherein the guide slot (16) are provided proximate the backside (21) of the upper part (10) wherein a back surface of each guide slot comes to rest on a rear surface (8) of the supports (4 and 5) when said upper part is not pivoted, wherein, further, the guide slots (16) are wider, at their upper sections (17) than the diameter of the bearing pins (6 and 7) so that a front surface of each pin will also engage against a forward surface of upper sections (17) of the guide slot (16) in the unpivoted position of the upper part (10).

3. A stand according to claim 2, wherein the upper part (10) bears flat upon the upper surface (3) of the lower part in the unpivoted position, and the front longitudinal edge of the upper part bears upon said upper surface in a pivoted position.

4. A stand according to either claims 2 or 3, wherein the distance adjacent supports (4 and 5) is less than the distance between the lateral end walls of the upper part (10).

5. A stand according to claim 4, wherein the upper part (10) has continuous front and back walls which cover the supports (4 and 5) from view.

* * * * *